US008251471B2

(12) United States Patent
Fontaine et al.

(10) Patent No.: US 8,251,471 B2
(45) Date of Patent: Aug. 28, 2012

(54) INDIVIDUAL JET VOLTAGE TRIMMING CIRCUITRY

(75) Inventors: Richard E. Fontaine, Plainfield, NH (US); Scott Leger, Fairlee, VT (US); Daniel Cote, Windsor, VT (US); Paul A. Hoisington, Noriwch, VT (US); Melvin L. Biggs, Norwich, VT (US); Todd W. Boucher, Lebanon, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 10/642,951

(22) Filed: Aug. 18, 2003

(65) Prior Publication Data

US 2005/0041073 A1 Feb. 24, 2005

(51) Int. Cl.
*B41J 29/38* (2006.01)

(52) U.S. Cl. ..... 347/10; 347/68; 347/5

(58) Field of Classification Search ..... 347/10, 347/11, 68, 9, 19, 29, 5, 14; 310/316.03
See application file for complete search history.

(56) References Cited

U.S. PATENT DOCUMENTS

| | | | | |
|---|---|---|---|---|
| 4,486,739 A | | 12/1984 | Franaszek et al. | |
| 4,563,689 A | * | 1/1986 | Murakami et al. | 347/11 |
| 4,639,735 A | * | 1/1987 | Yamamoto et al. | 347/68 |
| 5,138,333 A | | 8/1992 | Bartky et al. | |
| 5,359,350 A | * | 10/1994 | Nakano et al. | 347/10 |
| 5,361,084 A | | 11/1994 | Paton et al. | 347/15 |
| 5,361,420 A | | 11/1994 | Dobbs et al. | |
| 5,369,420 A | | 11/1994 | Bartky | 347/19 |
| 5,408,590 A | | 4/1995 | Dvorzsak | |
| 5,438,350 A | | 8/1995 | Kerry | 347/12 |
| 5,453,767 A | * | 9/1995 | Chang et al. | 347/10 |
| 5,463,414 A | | 10/1995 | Temple et al. | 347/68 |
| 5,463,416 A | | 10/1995 | Paton et al. | 347/100 |
| 5,510,048 A | | 4/1996 | Durbut et al. | |

(Continued)

FOREIGN PATENT DOCUMENTS

CN 1410780 A 4/2003

(Continued)

OTHER PUBLICATIONS

David A. Johns et al., "Analog Integrated Circuit Design", John Wiley & Sons, Inc., 1997, pp. 39-42, 396-397 and 398-400.

(Continued)

*Primary Examiner* — Lam S Nguyen
(74) *Attorney, Agent, or Firm* — Fish & Richardson P.C.

(57) ABSTRACT

Apparatus including a plurality of droplet ejection devices, an electric source and a controller. Each droplet ejection device includes a fluid chamber having an ejection nozzle, an electrically actuated displacement device associated with the chamber, and a switch having an input connected to the electric source, an output connected to the electrically actuated displacement device, and a control signal input that is controlled by the controller to control whether the input (and thus the electric source) is connected to the output (and thus the electrically actuated device). The electrically actuated displacement device moves between a displaced position and an undisplaced position to change the volume of the chamber as a capacitance associated with the electrically actuated displacement device changes in charge between an actuated condition and an unactuated condition. The controller provides respective charge control signals to respective control signal inputs to control the extent of change in charge on respective capacitances by the time that the respective switch connects the electrical signal to the respective electrically actuated displacement device.

19 Claims, 5 Drawing Sheets

U.S. PATENT DOCUMENTS

| | | | | |
|---|---|---|---|---|
| 5,512,796 | A | 4/1996 | Paton | 310/358 |
| 5,512,922 | A | 4/1996 | Paton | 347/12 |
| 5,521,619 | A * | 5/1996 | Suzuki et al. | 347/10 |
| 5,604,711 | A | 2/1997 | Cheung | |
| 5,604,771 | A | 2/1997 | Quiros | |
| 5,631,675 | A * | 5/1997 | Futagawa | 347/10 |
| 5,663,217 | A | 9/1997 | Kruse | 523/161 |
| 5,668,579 | A * | 9/1997 | Fujii et al. | 347/10 |
| 5,731,048 | A | 3/1998 | Ashe et al. | 427/585 |
| 5,740,332 | A | 4/1998 | Murakami | |
| 5,779,837 | A | 7/1998 | Harvey | 156/153 |
| 5,784,171 | A | 7/1998 | Kano | |
| 5,790,139 | A | 8/1998 | Umeno et al. | 347/10 |
| 5,825,375 | A | 10/1998 | Droit et al. | |
| 5,837,046 | A | 11/1998 | Schofield et al. | 106/31.86 |
| 5,842,258 | A | 12/1998 | Harvey et al. | 29/25.23 |
| 5,843,219 | A | 12/1998 | Griffin et al. | 106/31.88 |
| 5,854,886 | A | 12/1998 | MacMillan et al. | |
| 5,855,713 | A | 1/1999 | Harvey | 156/153 |
| 5,903,754 | A | 5/1999 | Pearson | |
| 5,910,372 | A | 6/1999 | Griffin et al. | 428/429 |
| 5,941,951 | A | 8/1999 | Day et al. | |
| 5,959,643 | A | 9/1999 | Temple et al. | 347/40 |
| 5,975,672 | A | 11/1999 | Wen | 347/15 |
| 5,984,448 | A | 11/1999 | Yanagawa | |
| 5,984,464 | A | 11/1999 | Steinfield et al. | 347/87 |
| 5,997,124 | A | 12/1999 | Capps et al. | 347/14 |
| 6,010,202 | A | 1/2000 | Arnott | 347/10 |
| 6,014,153 | A | 1/2000 | Harvey | 347/71 |
| 6,033,055 | A | 3/2000 | Nagoshi et al. | |
| RE36,667 | E | 4/2000 | Michaelis et al. | 347/69 |
| 6,046,822 | A | 4/2000 | Wen et al. | 358/1.9 |
| 6,088,050 | A | 7/2000 | Ng | |
| 6,089,698 | A | 7/2000 | Temple et al. | 347/47 |
| 6,092,886 | A | 7/2000 | Hosono | |
| 6,102,513 | A | 8/2000 | Wen | |
| 6,106,092 | A | 8/2000 | Norigoe et al. | 347/11 |
| 6,123,405 | A | 9/2000 | Temple et al. | 347/10 |
| 6,193,343 | B1 | 2/2001 | Norigoe et al. | 347/11 |
| 6,217,141 | B1 | 4/2001 | Nakamura et al. | 347/10 |
| 6,228,311 | B1 | 5/2001 | Temple et al. | 264/400 |
| 6,232,135 | B1 | 5/2001 | Ashe et al. | 438/21 |
| 6,257,689 | B1 | 7/2001 | Yonekubo | 347/11 |
| 6,260,951 | B1 | 7/2001 | Harvey et al. | 347/49 |
| 6,270,179 | B1 | 8/2001 | Nou | |
| 6,276,772 | B1 * | 8/2001 | Sakata et al. | 347/10 |
| 6,281,913 | B1 | 8/2001 | Webb | 347/46 |
| 6,286,943 | B1 | 9/2001 | Ashe et al. | 347/71 |
| 6,295,077 | B1 | 9/2001 | Suzuki | |
| 6,312,076 | B1 | 11/2001 | Taki et al. | 347/10 |
| 6,328,395 | B1 | 12/2001 | Kitahara et al. | |
| 6,331,040 | B1 | 12/2001 | Yonekubo et al. | |
| 6,331,045 | B1 | 12/2001 | Harvey et al. | 347/54 |
| 6,339,480 | B1 | 1/2002 | Yamada et al. | |
| 6,352,328 | B1 | 3/2002 | Wen et al. | 347/15 |
| 6,379,440 | B1 | 4/2002 | Tatum et al. | 106/31.13 |
| 6,384,930 | B1 | 5/2002 | Ando | |
| 6,399,402 | B2 | 6/2002 | Ashe et al. | 438/21 |
| 6,402,278 | B1 | 6/2002 | Temple | 347/12 |
| 6,402,282 | B1 | 6/2002 | Webb | 347/15 |
| 6,412,924 | B1 | 7/2002 | Ashe et al. | 347/69 |
| 6,422,690 | B1 | 7/2002 | Harvey et al. | 347/68 |
| 6,437,879 | B1 | 8/2002 | Temple | 358/3.01 |
| 6,460,991 | B1 | 10/2002 | Temple et al. | 347/104 |
| 6,467,863 | B1 * | 10/2002 | Imanaka et al. | 347/9 |
| 6,476,096 | B1 | 11/2002 | Molloy et al. | 523/160 |
| 6,505,918 | B1 | 1/2003 | Condie et al. | 347/69 |
| 6,517,195 | B1 | 2/2003 | Koeda | 347/68 |
| 6,468,779 | B1 | 5/2003 | Pulman et al. | 347/10 |
| 6,565,191 | B1 | 5/2003 | Bolash et al. | |
| 6,568,779 | B1 | 5/2003 | Pulman et al. | 347/10 |
| 6,572,221 | B1 | 6/2003 | Harvey et al. | 347/68 |
| 6,652,068 | B2 | 11/2003 | Hsu et al. | |
| 6,685,297 | B2 * | 2/2004 | Butterfield et al. | 347/19 |
| 6,752,482 | B2 | 6/2004 | Fukano et al. | |
| 6,764,154 | B2 | 7/2004 | Nishikori et al. | |
| 6,802,589 | B2 * | 10/2004 | Yonekubo et al. | 347/29 |
| 6,882,711 | B1 | 4/2005 | Nicol | |
| 7,049,756 | B2 * | 5/2006 | Aiba et al. | 315/172 |
| 7,076,724 | B2 | 7/2006 | Cole et al. | |
| 7,234,788 | B2 | 6/2007 | Gardner | |
| 7,234,799 | B2 | 6/2007 | Kwan et al. | |
| 7,436,540 | B2 | 10/2008 | Okamoto et al. | |
| 7,722,147 | B2 | 5/2010 | Gardner | |
| 7,907,298 | B2 | 3/2011 | Gardner et al. | |
| 7,911,625 | B2 | 3/2011 | Martin et al. | |
| 2002/0033644 | A1 * | 3/2002 | Takamura et al. | 307/109 |
| 2002/0186393 | A1 | 12/2002 | Pochuer et al. | |
| 2003/0081227 | A1 | 5/2003 | Williams | |
| 2003/0160836 | A1 | 8/2003 | Fukano et al. | |
| 2004/0000560 | A1 | 1/2004 | Henry et al. | |
| 2004/0070791 | A1 | 4/2004 | Pattusamy et al. | |
| 2004/0113959 | A1 | 6/2004 | Tamura | |
| 2005/0018940 | A1 | 1/2005 | Obayashi | |
| 2005/0270329 | A1 | 12/2005 | Hoisington et al. | |
| 2006/0050099 | A1 | 3/2006 | Murakami et al. | |
| 2006/0066701 | A1 | 3/2006 | Hirakawa | |
| 2006/0082797 | A1 | 4/2006 | Gardner | |
| 2006/0082811 | A1 | 4/2006 | Gardner et al. | |
| 2006/0082812 | A1 | 4/2006 | Gardner et al. | |
| 2006/0082813 | A1 | 4/2006 | Martin et al. | |
| 2006/0082814 | A1 | 4/2006 | Gardner | |
| 2006/0087523 | A1 | 4/2006 | Horsnell et al. | |
| 2006/0092201 | A1 | 5/2006 | Gardner | |
| 2006/0092437 | A1 | 5/2006 | Martin | |
| 2006/0098036 | A1 | 5/2006 | Gardner | |
| 2009/0010731 | A1 | 1/2009 | Heusel | |

FOREIGN PATENT DOCUMENTS

| | | | |
|---|---|---|---|
| CN | 101040505 | | 9/2007 |
| CN | 101052942 | | 10/2007 |
| CN | 101052943 | | 10/2007 |
| CN | 101052974 | | 10/2007 |
| CN | 101091153 | A | 12/2007 |
| CN | 101189622 | | 5/2008 |
| EP | 375147 | A3 | 4/1991 |
| EP | 0 600 707 | | 6/1994 |
| EP | 0 827 838 | | 3/1998 |
| EP | 810097 | A4 | 4/1998 |
| EP | 0 876 915 | | 11/1998 |
| EP | 0 899 102 | | 3/1999 |
| EP | 0 925 922 | | 6/1999 |
| EP | 919382 | A2 | 6/1999 |
| EP | 0 964 339 | | 12/1999 |
| EP | 1 212 201 | | 6/2002 |
| EP | 1 267 254 | | 12/2002 |
| EP | 1 293 341 | | 3/2003 |
| EP | 1452313 | | 9/2004 |
| EP | 1452313 | A1 | 9/2004 |
| EP | 1 470 921 | | 10/2004 |
| EP | 1 805 593 | | 7/2007 |
| EP | 1 810 127 | | 7/2007 |
| EP | 1 810 223 | | 7/2007 |
| EP | 1 810 482 | | 7/2007 |
| EP | 1 820 087 | | 8/2007 |
| EP | 1 820 088 | | 8/2007 |
| JP | 58055253 | U | 4/1983 |
| JP | 60-21254 | | 2/1985 |
| JP | 2-215537 | | 8/1990 |
| JP | 3065069 | A | 3/1991 |
| JP | 4273081 | | 9/1992 |
| JP | 6-340075 | | 12/1994 |
| JP | 7-076087 | | 3/1995 |
| JP | 09-058019 | | 3/1997 |
| JP | 09-231035 | | 9/1997 |
| JP | H9-277526 | | 10/1997 |
| JP | 9-327909 | | 12/1997 |
| JP | 10031566 | | 2/1998 |
| JP | 10336413 | | 12/1998 |
| JP | 11-058891 | | 3/1999 |
| JP | 11123861 | | 5/1999 |
| JP | 11-157055 | | 6/1999 |
| JP | 11338651 | | 12/1999 |
| JP | 2000-6389 | | 1/2000 |
| JP | 2000141829 | | 5/2000 |
| JP | 2000246862 | | 9/2000 |
| JP | 2000255019 | | 9/2000 |

| | | | |
|---|---|---|---|
| JP | 2000326560 | | 11/2000 |
| JP | 2000341359 | | 12/2000 |
| JP | 2001-026109 | | 1/2001 |
| JP | 2001001570 | | 1/2001 |
| JP | 2001010035 | A | 1/2001 |
| JP | 2001-63042 | | 3/2001 |
| JP | 2001-162793 | | 6/2001 |
| JP | 2001312382 | | 11/2001 |
| JP | 2002-171257 | | 4/2002 |
| JP | 2002512766 | | 4/2002 |
| JP | 2002-178510 | | 6/2002 |
| JP | 2002-292935 | | 10/2002 |
| JP | 2002-316414 | | 10/2002 |
| JP | 2002540701 | | 11/2002 |
| JP | 2003-1879 | | 1/2003 |
| JP | 2003-25561 | | 1/2003 |
| JP | 2003500899 | | 1/2003 |
| JP | 2003182192 | | 7/2003 |
| JP | 2003-226008 | | 8/2003 |
| JP | 2003244391 | | 8/2003 |
| JP | 2004-25510 | | 1/2004 |
| JP | 2004094586 | | 3/2004 |
| JP | 2004-106456 | | 4/2004 |
| JP | 2004-158000 | | 6/2004 |
| JP | 2004221629 | | 8/2004 |
| JP | 2004-268511 | | 9/2004 |
| JP | 2004-276394 | | 10/2004 |
| JP | 2004287993 | | 10/2004 |
| JP | 20055512194 | | 4/2005 |
| JP | 2008-516801 | | 5/2008 |
| JP | 2008-516802 | | 5/2008 |
| JP | 2008-516803 | | 5/2008 |
| JP | 2008-517379 | | 5/2008 |
| JP | 2008-517380 | | 5/2008 |
| JP | 2008-517811 | | 5/2008 |
| KR | 2007-0062532 | | 6/2007 |
| KR | 2007-0062549 | | 6/2007 |
| KR | 2007-0065348 | | 6/2007 |
| KR | 2007-0065383 | | 6/2007 |
| KR | 2007-0065384 | | 6/2007 |
| KR | 2007-0095277 | | 9/2007 |
| WO | 9952253 | | 10/1999 |
| WO | 0058842 | | 10/2000 |
| WO | 0070827 | | 11/2000 |
| WO | WO0112444 | A1 | 2/2001 |
| WO | WO0113328 | A1 | 2/2001 |
| WO | 03/064161 | | 8/2003 |
| WO | 2003/094502 | | 11/2003 |
| WO | WO2004000560 | A1 | 12/2003 |
| WO | 2005/018940 | | 3/2005 |
| WO | WO 2006/044530 | | 4/2006 |
| WO | WO 2006/044587 | | 4/2006 |
| WO | WO 2006/044597 | | 4/2006 |
| WO | WO2006044598 | A2 | 4/2006 |
| WO | WO2006044599 | A2 | 4/2006 |
| WO | WO 2006/049836 | | 5/2006 |
| WO | WO2006052466 | A1 | 5/2006 |
| WO | WO2006052885 | A1 | 5/2006 |

OTHER PUBLICATIONS

PCT Notification Concerning Transmittal of International Preliminary Report on Patentability (Chapter 1 of the Patent Cooperation Treaty) in PCT/US2004/026964 dated Mar. 2, 2006, 8 pages.
Chinese First Office Action in Chinese Application No. 200480023818X dated Nov. 16, 2007, 16 pages.
Chinese Second Office Action in Chinese Application No. 200480023818X dated Jan. 15, 2009, 7 pages.
Chinese Third Office Action in Chinese Application No. 200480023818X dated Sep. 29, 2009, 6 pages.
PCT Notification of Transmittal of the International Search Report and the Written Opinion of the International Searching Authority, or the Declaration in PCT/US2005/036936 dated Dec. 7, 2007, 16 pages.
PCT Notification Concerning Transmittal of International Preliminary Report on Patentability (Chapter 1 of the Patent Cooperation Treaty) in PCT/US2005/036936 dated Jan. 10, 2008, 8 pages.
Non-Final Office Action in U.S. Patent Appl. No. 10/966,205 dated May 29, 2008, 10 pages.
Chinese First Office Action in Chinese Application No. 200580043212.7 dated Sep. 25, 2009, 13 pages.
PCT Notification of Transmittal of the International Search Report and the Written Opinion of the International Searching Authority, or the Declaration in PCT/US2005/036935 dated May 31, 2006, 13 pages.
PCT Notification Concerning Transmittal of International Preliminary Report on Patentability (Chapter 1 of the Patent Cooperation Treaty) in PCT/US2005/036935 dated Apr. 26, 2007, 7 pages.
European Office Action in European Application No. 05 807 451.9-1245 dated Jul. 15, 2008, 5 pages.
Chinese First Office Action in Chinese Application No. 2005800432112 dated Aug. 22, 2008, 12 pages.
Chinese Second Office Action in Chinese Application No. 2005800432112 dated Sep. 4, 2009, 11 pages.
PCT Notification of Transmittal of the International Search Report and the Written Opinion of the International Searching Authority, or the Declaration in PCT/US2005/038743 dated Apr. 6, 2006, 14 pages.
PCT Notification Concerning Transmittal of International Preliminary Report on Patentability (Chapter 1 of the Patent Cooperation Treaty) in PCT/US2005/038743 dated May 18, 2007, 8 pages.
Chinese First Office Action in Chinese Application No. 200580045849.X dated Feb. 6, 2009, 11 pages.
European Office Action in European Application No. 05 813 253.1-2304 dated Jun. 5, 2009, 3 pages.
PCT Notification of Transmittal of the International Search Report and the Written Opinion of the International Searching Authority, or the Declaration in PCT/US2005/040288 dated Mar. 17, 2006, 21 pages.
PCT Notification Concerning Transmittal of International Preliminary Report on Patentability (Chapter 1 of the Patent Cooperation Treaty) in PCT/US2005/040288 dated May 18, 2007, 9 pages.
European Office Action in European Application No. 05824245.4-1251, PCT/US2005/040288 dated Jun. 29, 2007, 2 pages.
Non-Final Office Action in U.S. Appl. No. 10/966,205 dated May 29, 2008, 10 pages.
Chinese First Office Action in Chinese Application No. 2005800373538 dated Jun. 19, 2009, 4 pages.
Invitation Pursuant to Rule 63(1) EPC in European Application No. 04 781 618.6-1251 dated May 3, 2010, 3 pages.
Office Action issued in Japanese Patent Application No. 2006-524051 dated Jan. 5, 2010.
Office Action issued in U.S. Appl. No. 12/472,211 dated Jul. 9, 2010.
Office Action issued in European Patent Application No. 05807451.9 dated Jun. 16, 2010.
Office action issued Nov. 12, 2010 in counterpart European application No. 04781618.6, 10 pgs.
Office action issued Nov. 2, 2010 in counterpart Japanese application No. 2006-524051, 2pgs. (awaiting English translation).
Search Report issued Aug. 24, 2010 in counterpart European application No. 04781618.6, 3 pgs.
Office Action dated May 29, 2008 issued in U.S. Appl. No. 10/966,205 10 pgs.
Office Action dated Sep. 27, 2006 issued in U.S. Appl. No. 10/981,072 13 pgs.
Office Action dated Oct. 23, 2006 issued in U.S. Appl. No. 10/981,888 13 pgs.
Office Action dated May 16, 2007 issued in U.S. Appl. No. 10/981,888 8 pgs.
Office Action dated Nov. 28, 2007 issued in U.S. Appl. No. 10/981,888 13 pgs.
Office Action dated Jul. 22, 2008 issued in U.S. Appl. No. 10/981,888 7 pgs.
Authorized Officer Athina Nickitas-Etienne, International Preliminary Report on Patentability for Application No. PCT/US2005/040288, dated May 18, 2007.
Authorized Officer Ludmilla Mako, International Search Report and Written Opinion for Application No. PCT/US2005/036920, dated Feb. 20, 2006.
Authorized Officer Sinnin Baharlou, International Preliminary Report on Patentability for Application No. PCT/US2005/036920, dated Apr. 26, 2007.

Authorized Officer Maria Rodriguez Novoa, International Search Report and Written Opinion issued in PCT/US2005/036934, dated Dec. 6, 2006.
Authorized Officer Nora Lindner, International Preliminary Report on Patentability for Application No. PCT/US2005/036934, dated Apr. 26, 2007.
Authorized Officer Marja Brouwers, International Search Report and Written Opinion for Application No. PCT/US2005/036807, dated Nov. 30, 2006.
Authorized Officer Beate Giffo-Schmitt, International Preliminary Report on Patentability for Application No. PCT/US2005/036807, dated May 10, 2007.
Authorized Officer Eric Walsh, International Search Report and Written Opinion for Application No. PCT/US2005/036808, dated Feb. 21, 2006.
Authorized Officer Beate Giffo-Schmitt, International Preliminary Report on Patentability for Application No. PCT/US2005/036808, dated Apr. 26, 2007.
Chinese Office Action dated Jun. 6 issued in CN2005800375139.
Chinese Office Action dated Aug. 14, 2009 issued in CN200580035204.8.
Chinese Office Action dated Jan. 16, 2009 issued in CN200580035204.8.
Chinese Office Action dated Jul. 18, 2008 issued in CN200580035204.8.
Chinese Office Action dated Feb. 12, 2010 issued in CN 200580035215.6.
Chinese Office action dated Mar. 13, 2009 issued in CN200580035215.6, 18 pgs.
Chinese Office Action dated Sep. 25, 2009 issued in CN200580035221.1.
European Office Action dated Mar. 24, 2009 issued in EP 05807759. 5.
European Office Action dated Aug. 10, 2009 issued in EP 05810801. 0.
European Office Action dated Jun. 8, 2010 issued in 05 807 451.9, 6 pgs.
European Office Action dated Jul. 21, 2008 issued in 05 813 253.1-2304, 3 pgs.
Japanese Office Action dated Aug. 6, 2010 issued in JP 2007-536879, 3 pages.
Japanese Office Action dated Jul. 7, 2010 issued in 2007-536905, 3 pages.
Japanese Office Action dated Aug. 13, 2010 issued in JP 2007-536913, 2 pages.
Office Action dated Feb. 18, 2009 issued in U.S. Appl. No. 10/966,205.
Office Action dated Jul. 29, 2009 issued in U.S. Appl. No. 10/966,205.
Office Action dated Jul. 23, 2008 issued in U.S. Appl. No. 10/966,023 16 pgs.
Office Action dated Jul. 23, 2008 issued in U.S. Appl. No. 10/966,022.
Office Action dated Feb. 3, 2009 issued in U.S. Appl. No. 10/966,022.
Office Action dated Aug. 4, 2008 issued in U.S. Appl. No. 10/966,024.
Office Action dated Jan. 27, 2009 issued in U.S. Appl. No. 10/966,024.
Office Action dated Aug. 7, 2009 issued in U.S. Appl. No. 10/966,024 29 pgs.
Office Action dated Jun. 11, 2008 issued in U.S. Appl. No. 10/966,019.
Office Action dated May 1, 2009 issued in U.S. Appl. No. 10/966,019 24 pgs.
Office Action dated Jun. 26, 2008 issued in U.S. Appl. No. 10/977,298 19 pgs.
8B/10B-encoding scheme. (8 pgs.) [Online], [retrieved on Sep. 3, 2008]. Retrieved from the Internet: <URL:http://en.wikipedia.org/wiki/8B/10B—encoding>.
IEEE 802.3 Standard. (4 pgs.)[Online], [retrieved on Sep. 6, 2008]. Retrieved from the Internet: <URL:http://en.wikicedia.orc/wiki/IEEE802.3>.
Sachs, "Fibre Channel and Related Standards", IEEE Communications Magazine, IEEE Service Center, vol. 34, Aug. 1996, pp. 40-50.
Fibre Channel Protocol. (7 pgs.).[Online], [retrieved on Sep. 7, 2008]. Retrieved from the Internet: URL:http://en.wikipedia.org/wiki/Fibre_Channel_Protocol.
Fibre Channel—Physical and Signaling Interface (FC-PH), American National Standards Institute, ANSI X3.230-1994.
International Search Report issued for PCT/US2004/026964, dated Mar. 3, 2005, 3 pages.
Authorized Officer Johannes Van Brummelen, International Search Report and Written Opinion for Application No. PCT/US2005/040288, dated Mar. 17, 2006.
Authorized Officer Lucia Ertl, International Search Report and Written Opinion for Application No. PCT/US2005/038743, dated Apr. 6, 2006.
Notification of Transmittal of the International Search Report and the Written Opinion of the International Searching Authority for International Application PCT/US2005/036936, dated Jul. 12, 2007, 16 pages.
Notification of Transmittal of the Preliminary Report on Patentability for International Application PCT/US2005/036936, dated Jan. 10, 2008.
Office Action, U.S. Appl. No. 10/966,205, dated May 29, 2008, 10 pages.
Office Action for U.S. Appl. No. 10/977,298, dated Jun. 26, 2008.
European Office Action for Application No. 05 813 253.1, dated Jul. 21, 2008.
Office Action for U.S. Appl. No. 10/966,024, dated Aug. 4, 2008.
Office Action for U.S. Appl. No. 10/966,024, dated Jan. 27, 2009.
Chinese Office Action for Application No. CN200580045849.X, dated Feb. 9, 2009.
Chinese Office Action for Application No. CN200580035215.6, dated Mar. 13, 2009.
European Office Action for Application No. 05 807 759.5, dated Mar. 24, 2009.
Chinese Office Action for Application No. CN2005800352156, dated Mar. 31, 2009.
Office Action for U.S. Appl. No. 10/966,024, dated Aug. 7, 2009.
Chinese Office Action for Application No. CN200580035204.8, dated Aug. 14, 2009.
Chinese Office Action for Application No. CN200580043211.2, dated Aug. 22, 2008.
Chinese Office Action for Application No. CN200580043211.2, dated Sep. 4, 2009.
Chinese Office Action for Application No. CN200480023818X dated Sep. 25, 2009.
Chinese Office Action for Application No. CN2005800432127, dated Sep. 25, 2009.
Office Action from European Patent Office from corresponding European Patent Application No. 04 781 618.6, mailed Nov. 12, 2010, 10 pages.
Office Acton from Japanese Patent Office from corresponding Japanese Patent Application No. JP 2007-536914, mailed Mar. 8, 2011, 12 pages.
Office Acton from Japanese Patent Office from corresponding Japanese Patent Application No. JP 2006-524051, mailed Jul. 26, 2011, 4 pages.
Office Action from Chinese Patent Office from corresponding Chinese Application No. 2008101098942, mailed Oct. 21, 2011, 2 pages.
Office Action from corresponding Japanese Patent Application No. 2007-540133, mailed Mar. 15, 2011, with English translation, 10 pages.
Office action dated May 2, 2011 from Korean Application No. 10-2006-7002616, 15 pgs.
Office action dated Mar. 8, 2011 from Chinese Application No. 201010167530.7, 4 pgs.
Office action dated Oct. 18, 2011from Japanese Application No. 2007-540348, 10 pgs.
Office action dated Nov. 11, 2011 from Chinese Application No. 200580043212.7, 5 pgs.

* cited by examiner

INDIVIDUAL JET VOLTAGE TRIMMING CIRCUITRY

BACKGROUND

The invention relates to droplet ejection devices.

Inkjet printers are one type of apparatus employing droplet ejection devices. In one type of inkjet printer, ink drops are delivered from a plurality of linear inkjet print head devices oriented perpendicular to the direction of travel of the substrate being printed. Each print head device includes a plurality of droplet ejection devices formed in a monolithic body that defines a plurality of pumping chambers (one for each individual droplet ejection device) in an upper surface and has a flat piezoelectric actuator covering each pumping chamber. Each individual droplet ejection device is activated by a voltage pulse to the piezoelectric actuator that distorts the shape of the piezoelectric actuator and discharges a droplet at the desired time in synchronism with the movement of the substrate past the print head device.

Each individual droplet ejection device is independently addressable and can be activated on demand in proper timing with the other droplet ejection devices to generate an image. Printing occurs in print cycles. In each print cycle, a fire pulse (e.g., 150 volts) is applied to all of the droplet ejection devices at the same time, and enabling signals are sent to only the individual droplet ejection devices that are to jet ink in that print cycle.

SUMMARY OF THE INVENTION

The invention features, in general, apparatus including a plurality of droplet ejection devices, an electric source and a controller. Each droplet ejection device includes a fluid chamber having an ejection nozzle, an electrically actuated displacement device associated with the chamber, and a switch having an input connected to the electric source, an output connected to the electrically actuated displacement device, and a control signal input that is controlled by the controller to control whether the input (and thus the electric source) is connected to the output (and thus the electrically actuated device). The electrically actuated displacement device moves between a displaced position and an undisplaced position to change the volume of the chamber as a capacitance associated with the electrically actuated displacement device changes in charge between an actuated condition and an unactuated condition. The controller provides respective charge control signals to respective control signal inputs to control the extent of change in charge on respective capacitances by the time that the respective switch connects the electrical signal to the respective electrically actuated displacement device.

Particular embodiments of the invention may include one or more of the following features.

The actuated condition of the electrically actuated displacement device corresponds to a charged condition, and the unactuated condition corresponds to an uncharged condition. The controller controls the extent of charge placed on respective capacitances by the time that the respective the switch connects the electrical signal to the respective electrically actuated displacement device. Each droplet ejection device can also include a second switch that has a second input connected to a discharging electrical terminal, a second output connected to the electrically actuated displacement device, and a second control signal input to determine whether the second input is connected to or disconnected from the second output, and the controller can provide respective discharge control signals to respective second control signal inputs to control discharge of the charge on respective capacitances.

Each droplet ejection device can include a first resistance between the electric source and the electrically actuated displacement device. Each droplet ejection device can include a second resistance between the discharging electrical terminal and the electrically actuated displacement device.

The first resistance can be between the electrical source and the electrically actuated displacement device and can be external of an electrical path from the electrically actuated displacement device to the second switch, and the second resistance can be included in the electrical path from the electrically actuated device to the discharging electrical terminal. Alternatively, a single resistance can be used to charge and discharge a respective capacitance. A plurality of resistors, voltages and switches can be connected to each electrically actuated displacement device and controlled by the controller to change the charge on the capacitance. The discharging electrical terminal can be at ground. The electrical signal can be a controlled voltage signal, a controlled current signal, or a constant current.

When the first control signal is a constant voltage, the first control signal can terminate the connection of the constant voltage to the electrically actuated displacement device when the charge on the electrically actuated displacement device is at a predetermined value which is less than the constant voltage. The electrically actuated displacement device can be a piezoelectric actuator.

The control signal(s) can be controlled to provide uniform droplet volumes or velocities from the plurality of droplet ejection devices. The control signal(s) can be controlled to provide predetermined different drop volumes or velocities from different droplet ejection devices so as to provide gray scale control. The first and second control signals can be controlled to connect the electrical signal to respective electrically actuated displacement devices for respective predetermined times. A control signal can be controlled to connect the electrical signal to respective electrically actuated displacement devices until respective electrically actuated displacement devices achieve respective predetermined charge voltages. The control signal(s) can be controlled to provide a voltage that is insufficient to eject a droplet, but is sufficient to move a meniscus of a liquid at an ejection nozzle of the droplet ejection device. The control signals can be controlled to inject noise into images being printed so as to break up possible print patterns and banding. The control signals can be controlled to vary the amplitude of charge as well as the length of time of charge on the electrically actuated displacement device for the first droplet out of a droplet ejection device so as to match subsequent droplets.

In particular embodiments the controller adds a delay to a firing pulse for a displacement device when that device and an adjacent device are called upon to both fire at the same time. The leading edge of firing pulse for the delayed device is delayed by the delay amount after the leading edge of the firing pulse of the undelayed displacement device.

The apparatus can be an inkjet print head. The controller can include a field programmable gate array on a circuit board mounted to a monolithic body in which the pumping chambers are formed. The controller can control the first switch as a function of the frequency of droplet ejection to reduce variation in drop volume as a function of frequency.

Particular embodiments of the invention may include one or more of the following advantages. The charging up of an actuator to a desired charge and then disconnecting the electric source results in a saving in electricity over driving a device to a voltage and maintaining the voltage. One can also individually control the charge on devices, the slope of the change in charge, and the timing and slope of discharge to achieve various effects such as uniform droplet volume or velocity and gray scale control.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
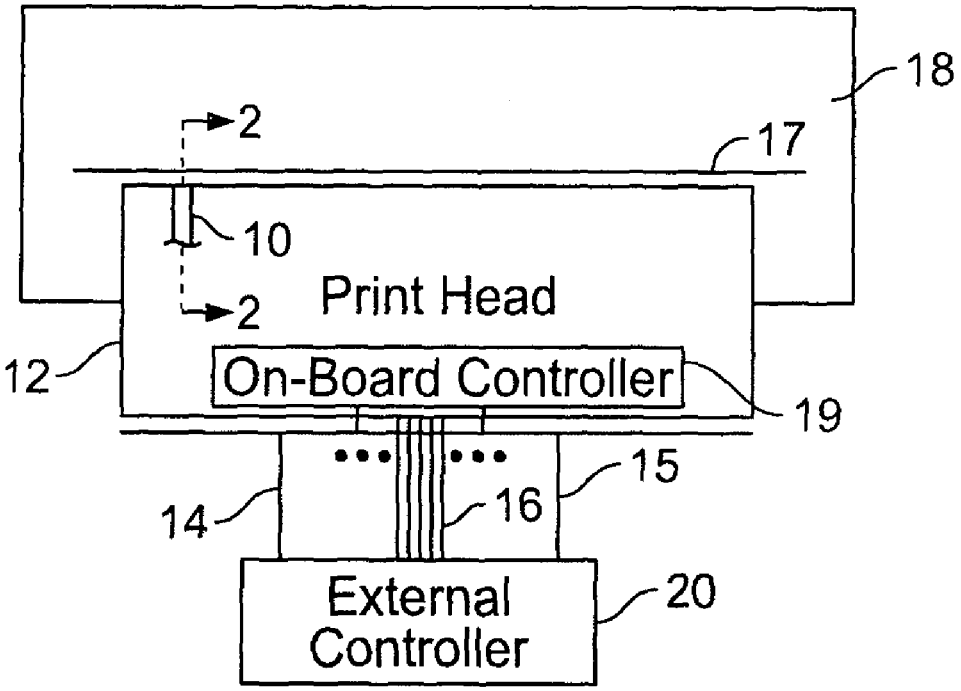
FIG. 1 is a diagrammatic view of components of an inkjet printer.

As shown in FIG. 1, the 128 individual droplet ejection devices 10 (only one is shown on FIG. 1) of print head 12 are driven by constant voltages provided over supply lines 14 and 15 and distributed by on-board control circuitry 19 to control firing of the individual droplet ejection devices 10. External controller 20 supplies the voltages over lines 14 and 15 and provides control data and logic power and timing over additional lines 16 to on-board control circuitry 19. Ink jetted by the individual ejection devices 10 can be delivered to form print lines 17 on a substrate 18 that moves under print head 12. While the substrate 18 is shown moving past a stationary print head 12 in a single pass mode, alternatively the print head 12 could also move across the substrate 18 in a scanning mode.

Figure 2:
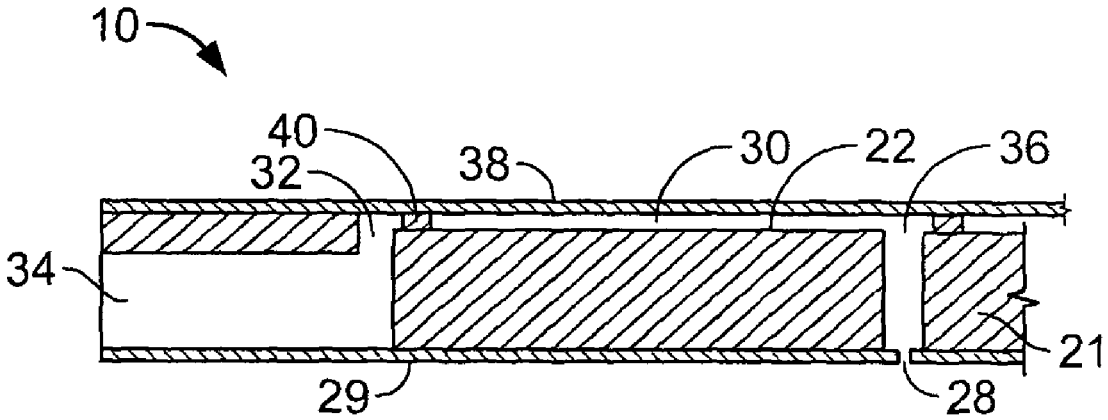
FIG. 2 is a vertical section, taken at 2-2 of FIG. 1, of a portion of a print head of the FIG. 1 inkjet printer showing a semiconductor body and an associated piezoelectric actuator defining a pumping chamber of an individual droplet ejection device of the print head.

Referring to FIG. 2, each droplet ejection device 10 includes an elongated pumping chamber 30 in the upper face of semiconductor block 21 of print head 12. Pumping chamber 30 extends from an inlet 32 (from the source of ink 34 along the side) to a nozzle flow path in descender passage 36 that descends from the upper surface 22 of block 21 to a nozzle opening 28 in lower layer 29. A flat piezoelectric actuator 38 covering each pumping chamber 30 is activated by a voltage provided from line 14 and switched on and off by control signals from on-board circuitry 19 to distort the piezoelectric actuator shape and thus the volume in chamber 30 and discharge a droplet at the desired time in synchronism with the relative movement of the substrate 18 past the print head device 12. A flow restriction 40 is provided at the inlet 32 to each pumping chamber 30.

Figure 3:
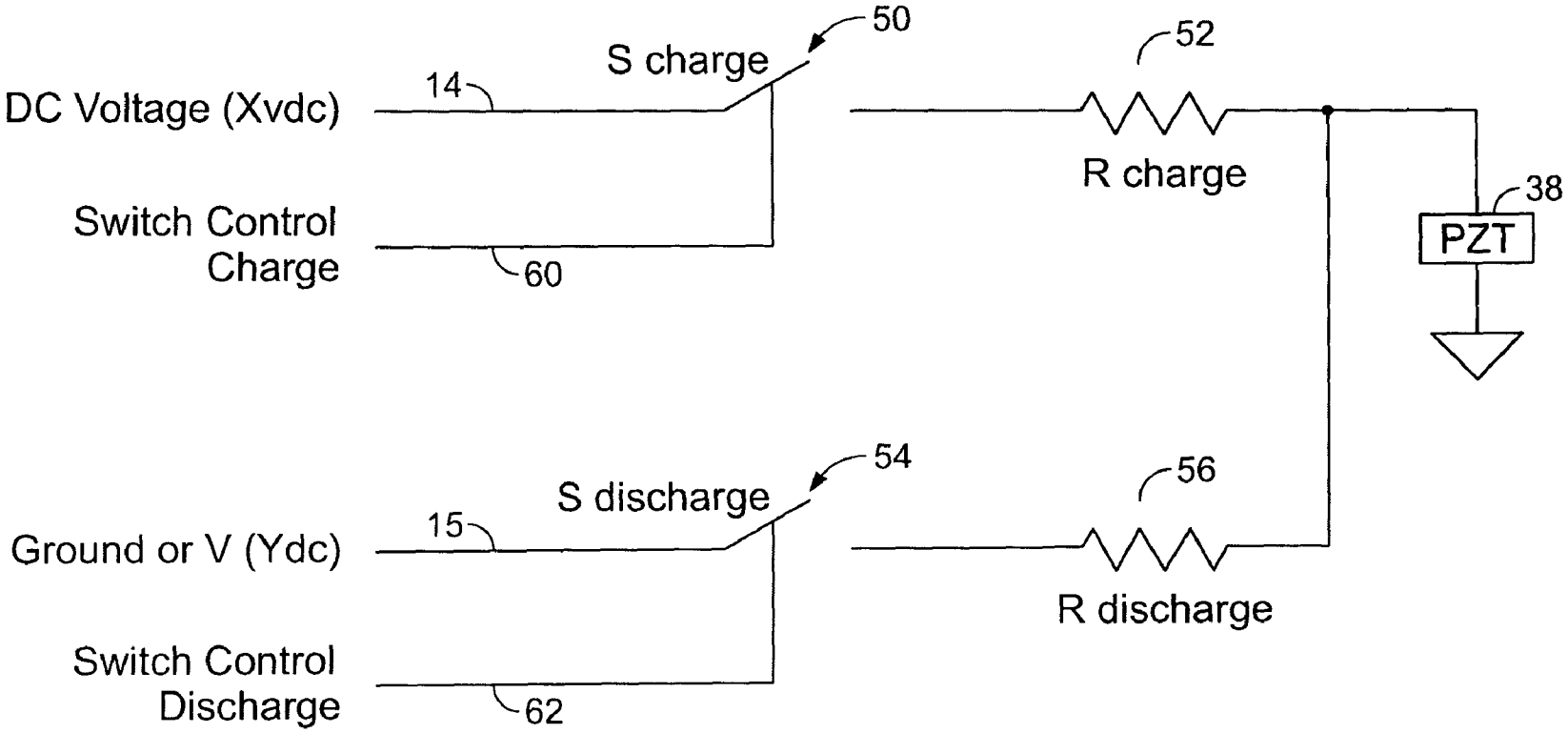
FIG. 3 is a schematic showing electrical components associated with an individual droplet ejection device.

FIG. 3 shows the electrical components associated with each individual droplet ejection device 10. The circuitry for each device 10 includes a charging control switch 50 and charging resistor 52 connected between the DC charge voltage Xvdc from line 14 and the electrode of piezoelectric actuator 38 (acting as one capacitor plate), which also interacts with a nearby portion of an electrode (acting as the other capacitor plate) which is connected to ground or a different potential. The two electrodes forming the capacitor could be on opposite sides of piezoelectric material or could be parallel traces on the same surface of the piezoelectric material. The circuitry for each device 10 also includes a discharging control switch 54 and discharging resistor 56 connected between the DC discharge voltage Ydc (which could be ground) from line 15 and the same side of piezoelectric actuator 38. Switch 50 is switched on and off in response to a Switch Control Charge signal on control line 60, and switch 54 is switched on and off in response to a Switch Control Discharge signal on control line 62.

Figure 4:
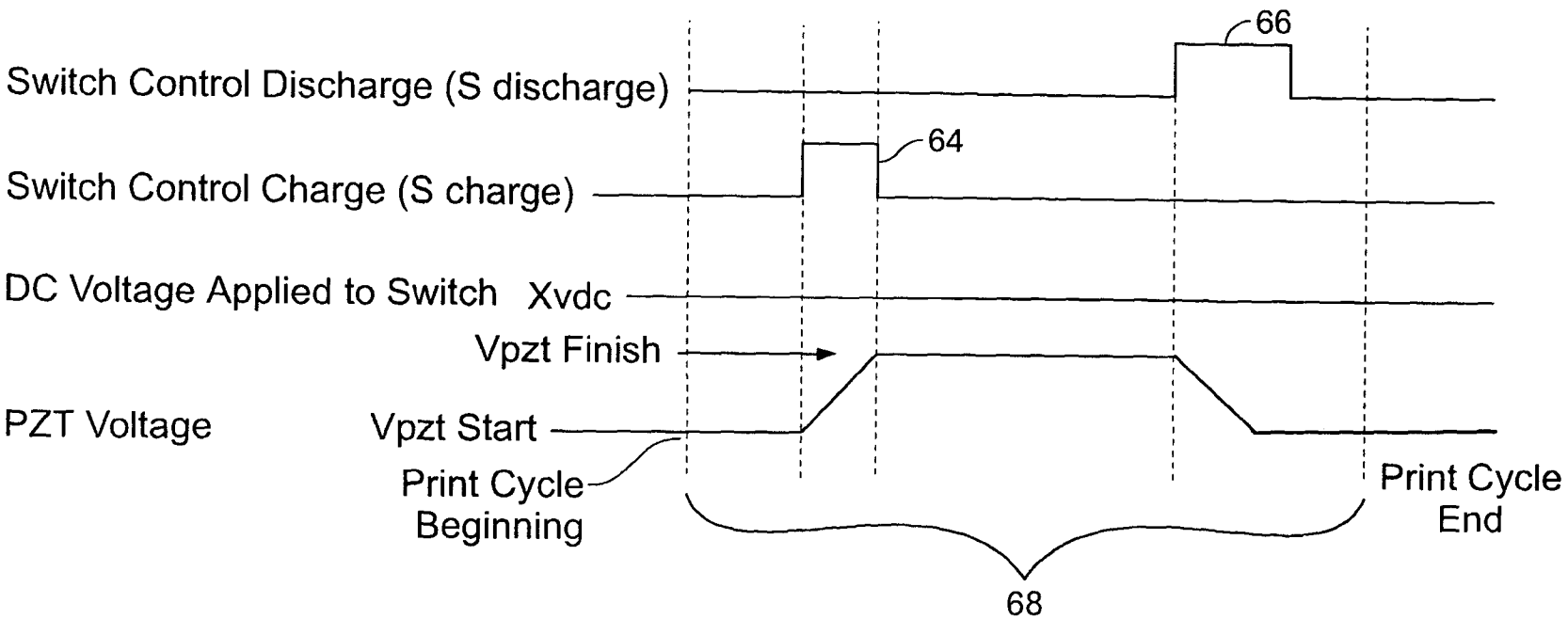
FIG. 4 is a timing diagram for the operation of the FIG. 3 electrical components.

Referring to FIGS. 3 and 4, piezoelectric actuator 38 functions as a capacitor; thus, the voltage across piezoelectric actuator ramps up from Vpzt_start after switch 50 is closed in response to switch charge pulse 64 on line 60. At the end of pulse 64, switch 50 opens, and the ramping of voltage ends at Vpzt_finish (a voltage less than Xvdc). Piezoelectric actuator 38 (acting as a capacitor) then generally maintains its voltage Vpzt_finish (it may decay slightly as shown in FIG. 4), until it is discharged by connection to a lower voltage Ydc by discharge control switch 54, which is closed in response to switch discharge pulse 66 on line 62. The speeds of ramping up and down are determined by the voltages on lines 14 and 15 and the time constants resulting from the capacitance of piezoelectric actuator 38 and the resistances of resistors 52 and 56. The beginning and end of print cycle 68 are shown on FIG. 4. Pulses 64 and 66 are thus timed with respect to each other to maintain the voltage on piezoelectric actuator 38 for the desired length of time and are timed with respect to the print cycle 68 to eject the droplet at the desired time with respect to movement of substrate 18 and the ejection of droplets from other ejection devices 10. The length of pulse 64 is set to control the magnitude of Vpzt, which, along with the width of the PZT voltage between pulses 64, 66, controls drop volume and velocity. If one is discharging to $Y_{vdc}$ the length of pulse 66 should be long enough to cause the output voltage to get as close as desired to $Y_{vdc}$; if one is discharging to an intermediate voltage, the length of pulse 66 should be set to end at a time set to achieve the intermediate voltage.

Figure 5:
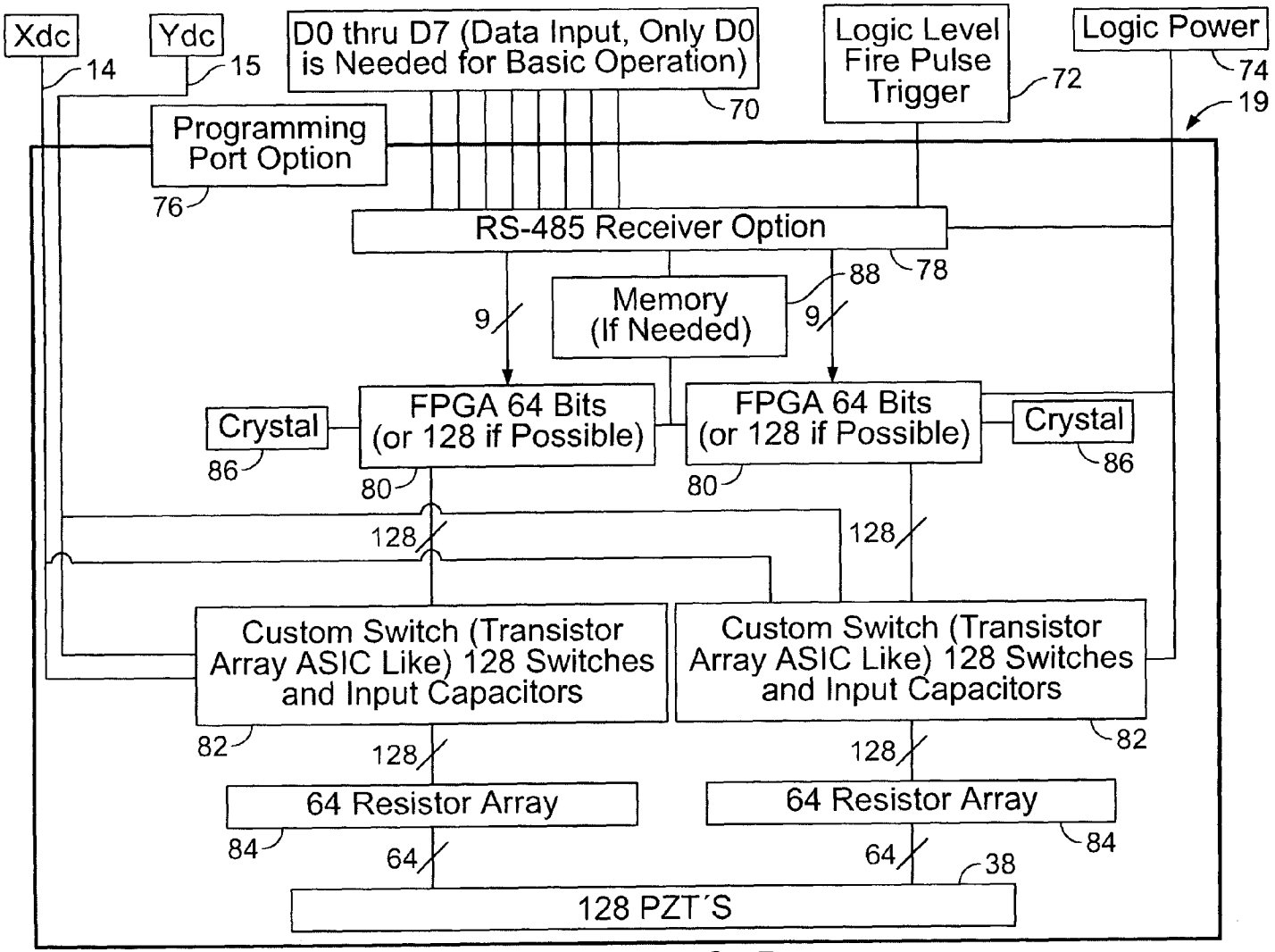
FIG. 5 is a block diagram of circuitry of a print head of the FIG. 1 printer.

Referring to FIG. 5, on-board control circuitry 19 includes inputs for constant voltages Xvdc and Ydc over lines 14, 15 respectively, D0-D7 data inputs 70, logic level fire pulse trigger 72 (to synchronize droplet ejection to relative movement of substrate 18 and print head 12), logic power 74 and optional programming port 76. Circuitry 19 also includes receiver 78, field programmable gate arrays (FPGAs) 80, transistor switch arrays 82, resistor arrays 84, crystals 86, and memory 88.

Transistor switch arrays 82 each include the charge and discharge switches 50, 54 for 64 droplet ejection devices 10.

FPGAs 80 each include logic to provide pulses 64, 66 for respective piezoelectric actuators 38 at the desired times. D0-D7 data inputs 70 are used to set up the timing for individual switches 50, 54 in FPGAs 80 so that the pulses start and end at the desired times in a print cycle 68. Where the same size droplet will be ejected from an ejection device throughout a run, this timing information only needs to be entered once, over inputs D0-D7, prior to starting a run. If droplet size will be varied on a drop-by-drop basis, e.g., to provide gray scale control, the timing information will need to be passed through D0-D7 and updated in the FPGAs at the beginning of each print cycle. Input D0 alone is used during printing to provide the firing information, in a serial bit stream, to identify which droplet ejection devices 10 are operated during a print cycle. Instead of FPGAs other logic devices, e.g., discrete logic or microprocessors, can be used.

Resistor arrays 84 include resistors 52, 56 for the respective droplet ejection devices 10. There are two inputs and one output for each of 64 ejection devices controlled by an array 84.

Programming port 76 can be used instead of D0-D7 data input 70 to input data to set up FPGAs 80. Memory 88 can be used to buffer or prestore timing information for FPGAs 80.

In operation under a normal printing mode, the individual droplet ejection devices 10 can be calibrated to determine appropriate timing for pulses 64, 66 for each device 10 so that each device will eject droplets with the desired volume and desired velocity, and this information is used to program FPGAs 80. This operation can also be employed without calibration so long as appropriate timing has been determined. The data specifying a print job are then serially transmitted over the D0 terminal of data input 72 and used to control logic in FPGAs to trigger pulses 64, 66 in each print cycle in which that particular device is specified to print in the print job.

In a gray scale print mode, or in operations employing drop-by-drop variation, information setting the timing for each device 10 is passed over all eight terminals D0-D7 of data input 70 at the beginning of each print cycle so that each device will have the desired drop volume during that print cycle.

FPGAs 80 can also receive timing information and be controlled to provide so-called tickler pulses of a voltage that is insufficient to eject a droplet, but is sufficient to move the meniscus and prevent it from drying on an individual ejection device that is not being fired frequently.

FPGAs 80 can also receive timing information and be controlled to eject noise into the droplet ejection information so as to break up possible print patterns and banding.

FPGAs 80 can also receive timing information and be controlled to vary the amplitude (i.e, Vpzt_finish) as well as the width (time between charge and discharge pulses 64, 66) to achieve, e.g., a velocity and volume for the first droplet out of an ejection device 10 as for the subsequent droplets during a job.

The use of two resistors 52, 56, one for charge and one for discharge, permits one to independently control the slope of ramping up and down of the voltage on piezoelectric actuator 38. Alternatively, the outputs of switches 50, 54 could be joined together and connected to a common resistor that is connected to piezoelectric actuator 38 or the joined together output could be directly connected to the actuator 38 itself, with resistance provided elsewhere in series with the actuator 38.

By charging up to the desired voltage (Vpzt_finish) and maintaining the voltage on the piezoelectric actuators 38 by disconnecting the source voltage Xvdc and relying on the actuator's capacitance, less power is used by the print head than would be used if the actuators were held at the voltage (which would be Xvdc) during the length of the firing pulse.

Other embodiments of the invention are within the scope of the appended claims. E.g., a switch and resistor could be replaced by a current source that is switched on and off. Also, common circuitry (e.g., a switch and resistor) could be used to drive a plurality of droplet ejection devices. Also, the drive pulse parameters could be varied as a function of the frequency of droplet ejection to reduce variation in drop volume as a function of frequency. Also, a third switch could be associated with each pumping chamber and controlled to connect the electrode of the piezoelectric actuator 38 to ground, e.g., when not being fired, while the second switch is used to connect the electrode of the piezoelectric actuator 38 to a voltage lower than ground to speed up the discharge.

It is also possible to create more complex waveforms. For example, switch 50 could be closed to bring the voltage up to V1, then opened for a period of time to hold this voltage, then closed again to go up to voltage V2. A complex waveform can be created by appropriate closings of switch 50 and switch 54.

Figure 6:
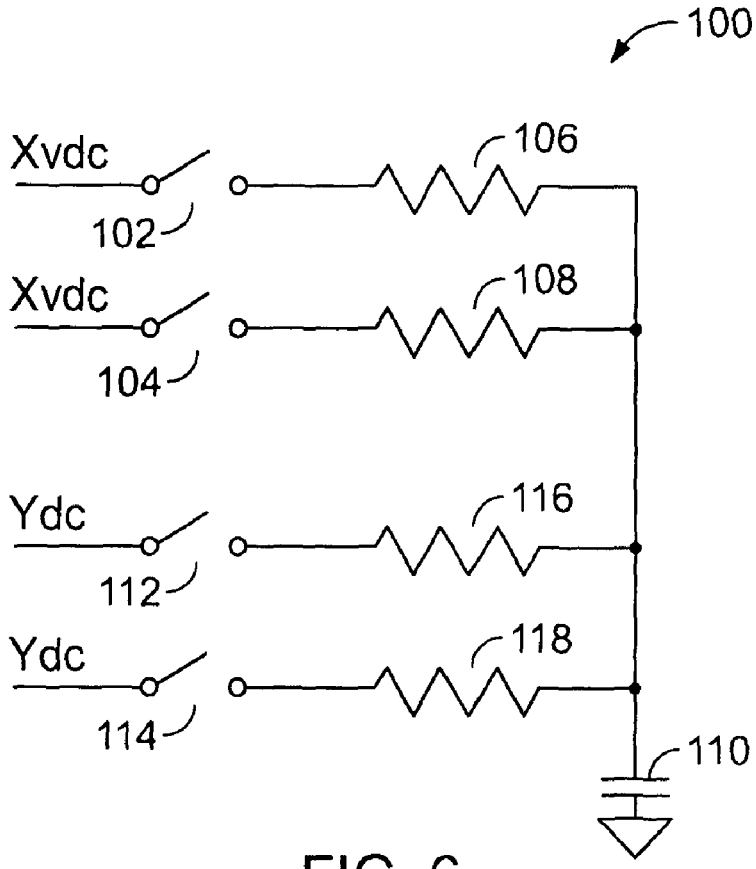
FIG. 6 is a schematic showing an alternative embodiment of electrical components associated with an individual droplet ejection device.
Figure 7:
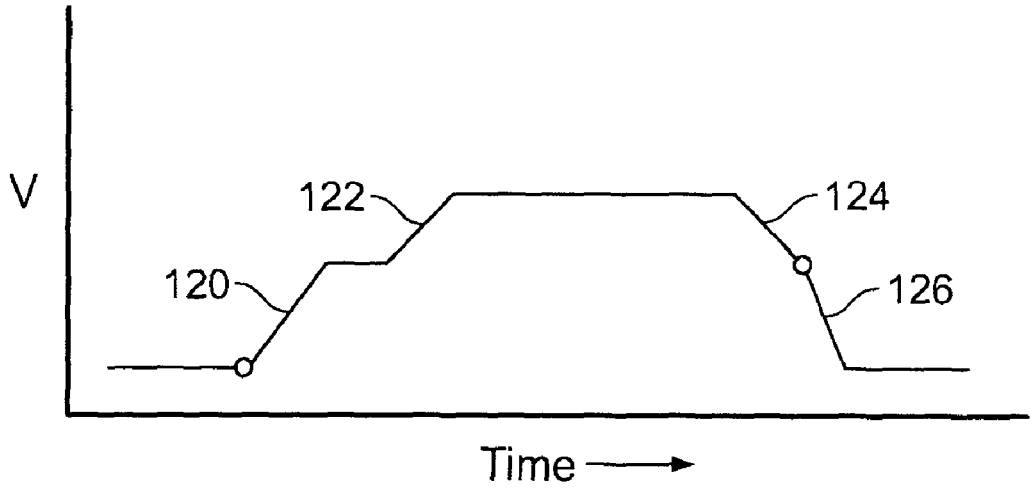
FIG. 7 is a timing diagram showing the charge voltage on the capacitance for the actuator for the operation of the FIG. 6 electrical components.

Multiple resistors, voltages, and switches could be used per droplet ejection device to get different slew rates as shown in FIGS. 6 and 7. FIG. 6 shows an alternative control circuit 100 for an injection device in which multiple (here two) charging control switches 102, 104 and associated charging resistors 106, 108 are used to charge the capacitance 110 of the piezoelectric actuator and multiple (here two) discharging control switches 112, 114 and associated discharging resistors 116, 118 are used to discharge the capacitance. FIG. 7 shows the resulting voltage charge on the capacitance. The ramp up at 120 is caused by having switch 102 closed while the other switches are open. The ramp up at 122 is caused by having switch 104 closed while the other switches are open. The ramp down at 124 is caused by having switch 112 closed while the other switches are open. The ramp down at 126 is caused by having switch 114 closed while the other switches are open.

What is claimed is:

1. An apparatus comprising:

droplet ejection devices each comprising an element to change a volume of a fluid chamber of one of the droplet ejection devices, the element having an electrical capacitance, each droplet ejection device being associated with a plurality of charging resistors; and control circuitry to effect uniform velocities of droplets ejected from at least two different ones of the droplet ejection devices by providing respective charge voltages or charge currents to the volume changing elements to individually control a charge on each volume changing element;

wherein for each droplet ejection device, the control circuitry provides the respective charge voltage or charge current by selecting a first charging resistor associated with the droplet ejection device to charge the electrical capacitance at a first rate followed by deselecting the first charging resistor to maintain the charge on the electrical capacitance at a first value for a first period of time, followed by selecting a second charging resistor associated with the droplet ejection device to charge the electrical capacitance at a second rate to increase the volume of the fluid chamber, followed by deselecting the second charging resistor to maintain the charge on the electrical capacitance at a second value for a second period of time, followed by selecting a first discharging resistor associated with the droplet ejection device to discharge the electrical capacitance at a third rate, followed by selecting a second discharging resistor associated with the droplet ejection device to discharge the electrical capacitance at a fourth rate to decrease the volume of the fluid chamber, wherein the first rate, the second rate, the third rate, and the fourth rate are all different rates.

2. The apparatus of claim 1 wherein the control circuitry effects uniform droplet velocities also by providing respective discharge voltages or discharge currents to the volume changing elements.

3. The apparatus of claim 2 wherein the control circuitry comprises discharging control switches to connect or disconnect discharge voltages or discharge currents to respective elements to discharge the respective electrical capacitances.

4. The apparatus of claim 1 wherein the control circuitry comprises charging control switches to connect or disconnect charge voltages or charge currents to respective elements through respective charging resistors to charge the respective electrical capacitances.

5. The apparatus of claim 1 wherein the volume changing element comprises an electrically actuated displacement device.

6. The apparatus of claim 1 in which the volume changing element has a first terminal and a second terminal, the first terminal receives the respective charge voltage or charge current, and the second terminal is connected to electrical ground.

7. The apparatus of claim 1 in which each of the first charging resistor and the second charging resistor consists of two terminals.

8. The apparatus of claim 1, further comprising an array of charging resistors, each droplet ejection device being associated with a plurality of the charging resistors, and an array of charging control switches to connect or disconnect charge voltages or charge currents to respective elements through respective charging resistors to charge the respective electrical capacitances, the array of charging control switches being distinct from the array of charging resistors.

9. The apparatus of claim 1 in which the control circuitry injects noise into images being printed to break up possible print patterns.

10. The apparatus of claim 1 in which the control circuitry selectively causes a constant current signal to charge the electrical capacitance.

11. The apparatus of claim 1 in which the control circuitry effects predetermined different drop velocities from different droplet ejection devices so as to provide gray scale control by providing respective charge voltages or charge currents to the volume changing elements.

12. The apparatus of claim 1 in which the control circuitry varies the amplitude of charge as well as the length of time of charge on the volume changing element for the first droplet out of the droplet ejection device so as to match subsequent droplets by providing respective charge voltages, charge currents, discharge voltages, or discharge currents to the volume changing element.

13. The apparatus of claim 1 in which the control circuitry controls charging of the electrical capacitance of each of the volume changing element as a function of a frequency of droplet ejection to reduce variation in drop volume as a function of the frequency by providing respective charge voltages or charge currents to the volume changing elements.

14. A method of operating droplet ejection devices each comprising an element to change a volume of a fluid chamber of one of the droplet ejection devices, the element having an electrical capacitance, each droplet ejection device being associated with a plurality of charging resistors, the method comprising:

effecting uniform velocities of droplets ejected from at least two different ones of the droplet ejection devices by providing respective charge voltages or charge currents to the volume changing elements to individually control a charge on each volume changing element; and for each droplet ejection device, providing the respective charge voltage or charge current by selecting a first charging resistor associated with the droplet ejection device to charge the electrical capacitance at a first rate followed by deselecting the first charging resistor to maintain the charge on the electrical capacitance at a first value for a first period of time, followed by selecting a second charging resistor associated with the droplet ejection device to charge the electrical capacitance at a second rate to increase the volume of the fluid chamber, followed by deselecting the second charging resistor to maintain the charge on the electrical capacitance at a second value for a second period of time, followed by selecting a first discharging resistor associated with the droplet ejection device to discharge the electrical capacitance at a third rate, followed by selecting a second discharging resistor associated with the droplet ejection device to discharge the electrical capacitance at a fourth rate to decrease the volume of the fluid chamber, wherein the first rate, the second rate, the third rate, and the fourth rate are all different rates.

15. The method of claim 14 wherein effecting uniform droplet velocities comprises providing respective discharge voltages or discharge currents to the volume changing elements.

16. The method of claim 15 wherein providing respective discharge voltages or discharge currents to the volume changing elements comprises using discharging control switches to connect or disconnect discharge voltages or discharge currents to respective elements to discharge the respective electrical capacitances.

17. The method of claim 14 wherein providing respective charge voltages or charge currents to the volume changing elements comprises using charging control switches to connect or disconnect charge voltages or charge currents to respective elements through respective charging resistors to charge the respective electrical capacitances.

18. The method of claim 14 wherein selecting a first charging resistor comprises selecting a first charging resistor that consists of two terminals, and selecting a second charging resistor comprises selecting a second charging resistor that consists of two terminals.

19. The method of claim 14 wherein providing a respective charge voltage or charge current to the volume changing element comprising providing a respective charge voltage or charge current to a first terminal of the volume changing element, and the method further comprises connecting a second terminal of the volume changing element to electrical ground.

* * * * *